US011904987B1

(12) United States Patent
Rigler

(10) Patent No.: US 11,904,987 B1
(45) Date of Patent: Feb. 20, 2024

(54) PERSONAL STANDING BALANCE ASSIST ASSEMBLY AND BALANCE ASSIST METHOD FOR RECREATIONAL WATERCRAFT

(71) Applicant: William Michael Rigler, Charlotte, NC (US)

(72) Inventor: William Michael Rigler, Charlotte, NC (US)

( * ) Notice: Subject to any disclaimer, the term of this patent is extended or adjusted under 35 U.S.C. 154(b) by 393 days.

(21) Appl. No.: 17/496,201

(22) Filed: Oct. 7, 2021

Related U.S. Application Data

(60) Provisional application No. 63/088,751, filed on Oct. 7, 2020.

(51) Int. Cl.
*B63B 34/26* (2020.01)
*B63B 34/21* (2020.01)

(52) U.S. Cl.
CPC ..... *B63B 34/26* (2020.02); *B63B 34/21* (2020.02)

(58) Field of Classification Search
CPC ..... B63B 34/26; B63B 34/21
See application file for complete search history.

(56) References Cited

U.S. PATENT DOCUMENTS 5,377,607 A 1/1995 Ross
6,220,197 B1 4/2001 Pohlman
7,124,702 B1 10/2006 Cameron
9,016,225 B1 4/2015 Jenkins
9,376,176 B1 6/2016 Holden
9,796,454 B1 * 10/2017 Phillips, Jr. ..... B63B 21/22
10,325,582 B2 * 6/2019 Antao ..... G01S 15/89
2014/0187108 A1 7/2014 Prade
2015/0072576 A1 3/2015 Malakiman
2018/0327059 A1 11/2018 Boyer et al.

FOREIGN PATENT DOCUMENTS

WO 2015002882 1/2015

* cited by examiner

*Primary Examiner* — Anthony D Wiest
(74) *Attorney, Agent, or Firm* — Schwartz Law Firm, P.C.; Jeffrey J. Schwartz

(57) ABSTRACT

A personal standing balance assist assembly is adapted for use in a recreational watercraft. The balance assist assembly includes a balance assist pole having a distal end for being grasped by an occupant in a standing position on the recreational watercraft. A scupper plug is located at a proximal end of the balance assist pole and is configured to engage the watercraft adjacent a top mouth of the scupper hole. A hull plug is configured to engage the watercraft adjacent a bottom mouth of the scupper hole. An elongated assembly connector extends vertically through the scupper hole and is adapted for urging the scupper plug and hull plug into close contact with the watercraft proximate respective top and bottom mouths of the scupper hole, thereby securing the balance assist assembly to the watercraft.

19 Claims, 6 Drawing Sheets

PERSONAL STANDING BALANCE ASSIST ASSEMBLY AND BALANCE ASSIST METHOD FOR RECREATIONAL WATERCRAFT

TECHNICAL FIELD AND BACKGROUND OF THE DISCLOSURE

The present disclosure relates broadly and generally to a personal standing balance assist assembly and balance assist method for recreational watercraft. The invention in applicable for use in a wide variety of watercraft including sit-on-top fishing kayaks, micro skiffs, stand-up paddle boards and others. Using an existing scupper hole, the invention readily and conveniently mounts to a deck of the watercraft and offers an additional point-of-contact allowing users to confidently stand upon the watercraft and maintain balance amidst boat waves, choppy waters, high winds and inclement weather, and other such conditions.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a personal standing balance assist assembly adapted for use in a recreational watercraft. The watercraft has a deck, a hull bottom, and at least one scupper hole extending vertically from the deck to the hull bottom. The balance assist assembly comprises a balance assist pole having opposing proximal and distal ends. The distal end is adapted for being grasped by an occupant in a standing position on the recreational watercraft. A scupper plug is located at the proximal end of the balance assist pole and is configured to engage the watercraft at a top mouth of the scupper hole. A hull plug is configured to engage the watercraft at a bottom mouth of the scupper hole. An elongated assembly connector is configured to extend vertically through the scupper hole and is adapted for urging the scupper plug and hull plug into close contact with the watercraft at respective top and bottom mouths of the scupper hole, thereby securing the balance assist assembly to the watercraft. The term "plug" refers broadly herein to any structure designed to extend within and/or around a mouth of the scupper hole.

According to another exemplary embodiment, the balance assist pole comprises telescoping inner and outer hollow tube sections.

According to another exemplary embodiment, a pole clamp operatively engages the outer tube section of the balance assist pole, and is adapted for releasably securing the balance assist pole at a selected height.

According to another exemplary embodiment, the pole clamp has a quick-release mechanism comprising a pivoted lever and clamp collar. The lever is adapted to readily open and close the clamp collar, thereby operatively releasing and securing the balance assist pole for selected height adjustment. In an alternative embodiment, the pole clamp may comprise a bolted clamp collar.

According to another exemplary embodiment, the balance assist pole is fabricated of a material selected from a group consisting of aluminum, carbon fiber, fiberglass, and plastic.

According to another exemplary embodiment, the distal end of the balance assist pole includes a non-slip handle. The term "non-slip" refers broadly herein to a handle having textured, contoured or sticky grip.

According to another exemplary embodiment, the scupper plug has a substantially frustoconical outer shape.

According to another exemplary embodiment, the scupper plug comprises a two-piece assembly including a core and an outside liner. The core defines a throughbore configured to receive the assembly connector through the scupper plug and into the proximal end of the balance assist pole. Alternatively, the scupper plug may comprise a single, integrally formed homogenous component.

According to another exemplary embodiment, the core of the scupper plug has an internal screw thread, and the assembly connector comprises a complementary threaded bolt configured to mate with the internal thread of the scupper plug core.

According to another exemplary embodiment, the hull plug is carried by the assembly connector proximate an enlarged head of the threaded bolt.

According to another exemplary embodiment, a washer is located between the hull plug and the enlarged head of the threaded bolt.

According to another exemplary embodiment, the hull plug has an integrally formed disk-shaped top portion and a stepped-down annular flange configured to seat at the bottom mouth of the scupper hole.

According to another exemplary embodiment, a pole-end insert is located at the proximal end of the balance assist pole. The exemplary insert has a cylindrical body residing inside the balance assist pole and a tapered outward extending fitting. The tapered fitting is configured to closely insert into a complementary top socket formed in the exemplary scupper plug.

In another exemplary embodiment, the present disclosure comprises a recreational watercraft incorporating a personal standing balance assist assembly as claimed and further described herein.

In yet another exemplary embodiment, the present disclosure comprises a personal standing balance assist method for an occupant of a recreational watercraft. The method includes grasping a distal end of a balance assist pole extending vertically from a deck of the watercraft. The balance assist pole has a proximal end affixed to a scupper hole formed through a hull of the watercraft. Utilizing the balance assist pole, the occupant maintains a standing position upon the watercraft as the watercraft floats on a body of water.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
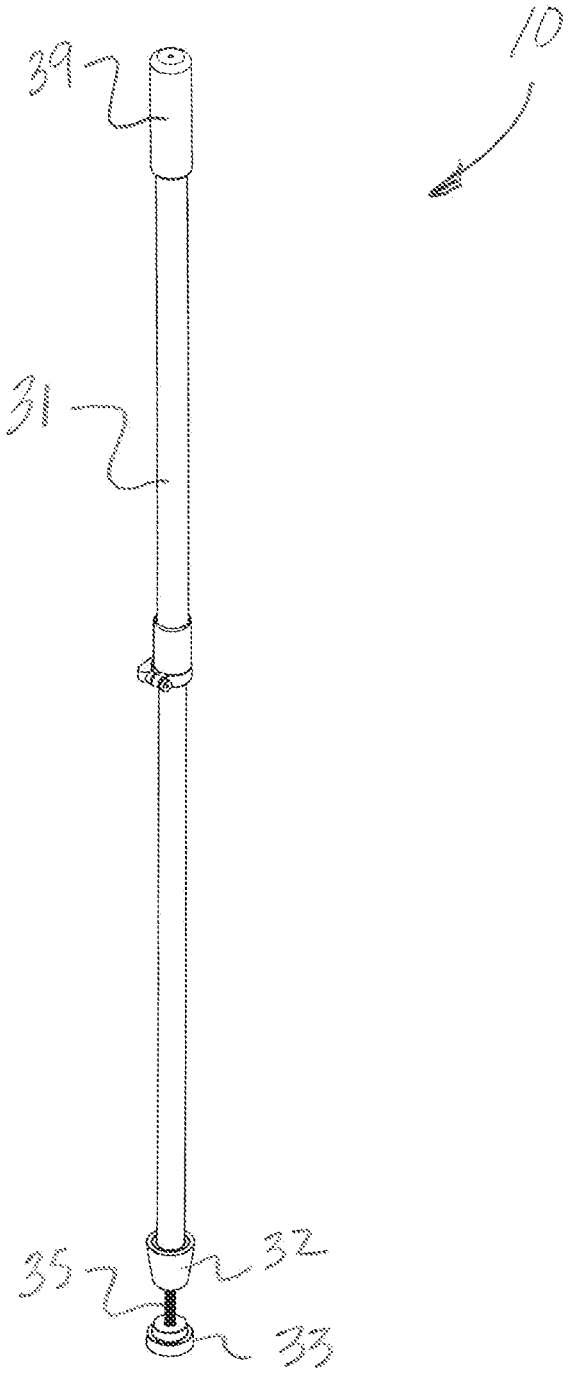
FIG. 1 is a perspective view of the present standing balance assist assembly according to one exemplary embodiment of the disclosure.
Figure 2:
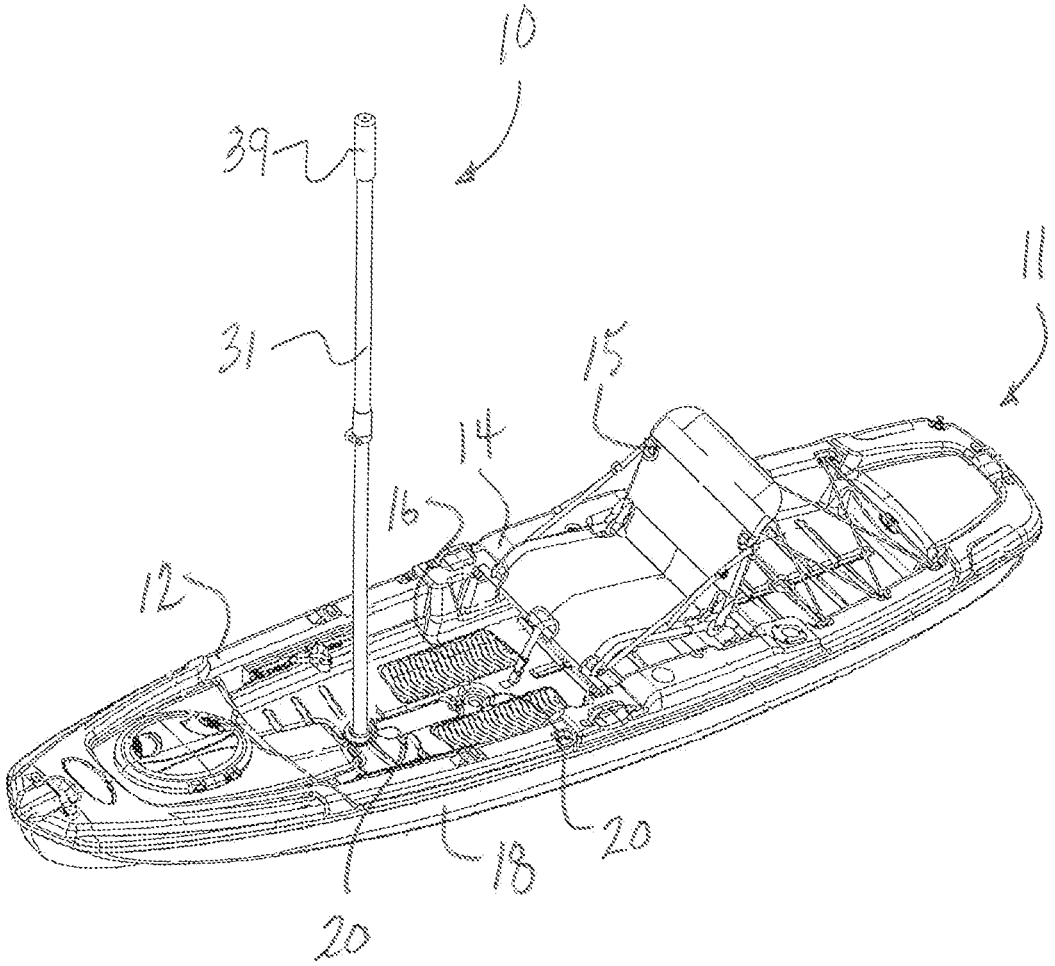
FIG. 2 illustrates the exemplary balance assist assembly installed in a conventional sit-on-top fishing kayak.

Referring now specifically to the drawings, a personal standing balance assist assembly according to one exemplary embodiment of the present disclosure is illustrated in FIGS. 1 and 2, and shown generally at broad reference numeral 10. The exemplary balance assist assembly 10 is especially applicable for use in a recreational watercraft, such as a sit-on-top fishing kayak 11, having conventional parts and features including a deck 12, cockpit 14, seat 15, foot wells 16, and hull 18, and a number of molded-in scupper holes 20 or "scuppers". Each scupper hole 20 extends vertically from the deck 12 to the hull bottom 18A (See FIG. 7), and ordinarily functions to drain water away from the deck 12 to keep water from accumulating inside the kayak 11 during use. There are typically one to six scupper holes 20 in a kayak spaced apart in and around the cockpit, foot wells and other areas of the deck 12.

Figure 7:
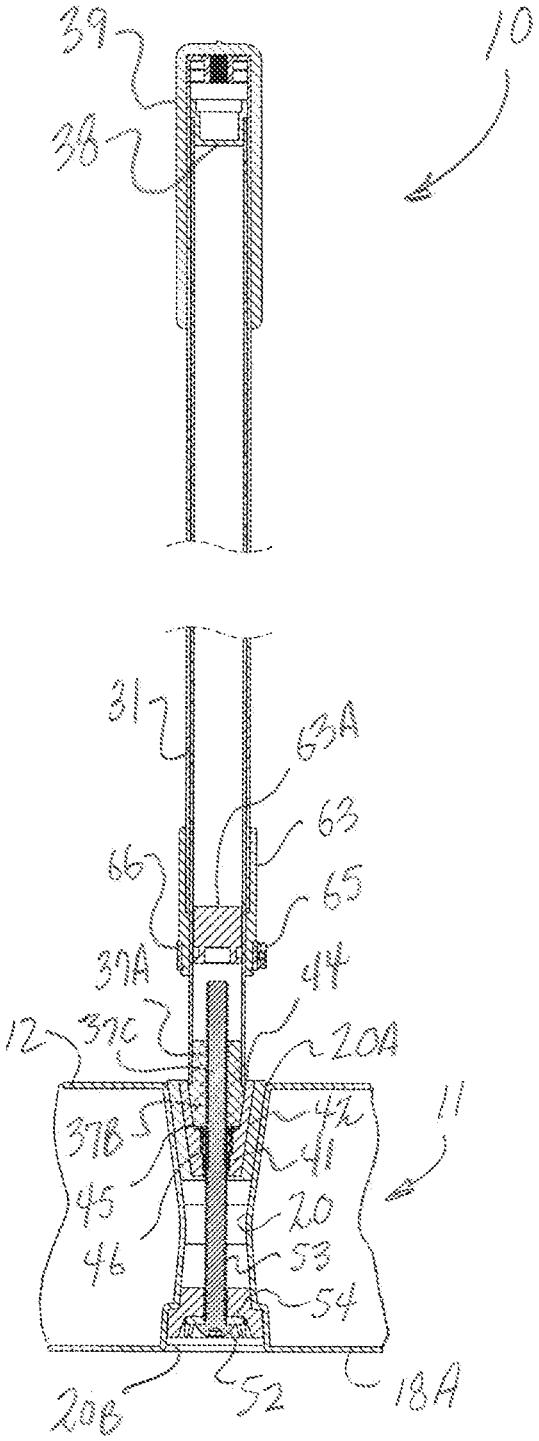
FIG. 7 is a cross-sectional view taken substantially alone line A-A of FIG. 6.
Figure 8:
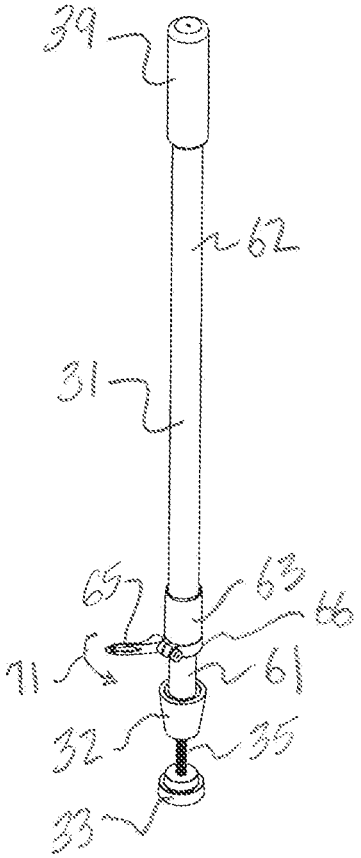
FIGS. 8 and 9 are further perspective views demonstrating height adjustment of the telescoping balance assist pole of the exemplary assembly.
Figure 9:
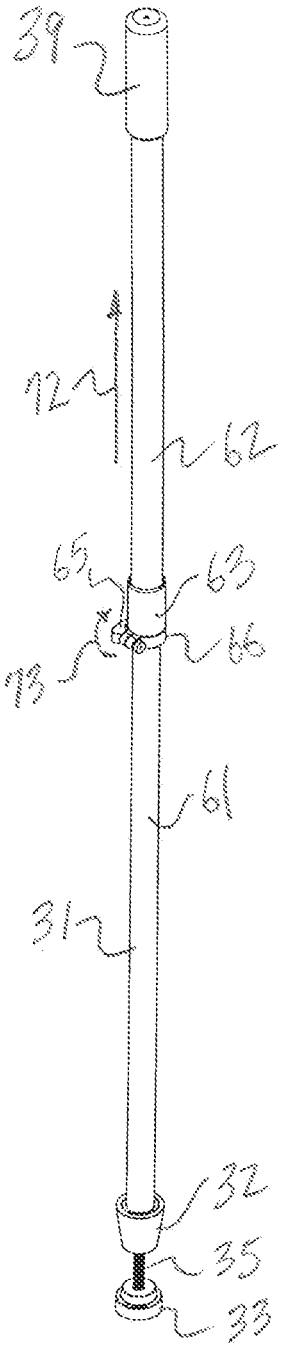

Referring to FIGS. 1, 3, and 4-7, the exemplary balance assist assembly 10 comprises a height-adjustable balance assist pole 31, a top scupper plug 32, a bottom hull plug 33 and an elongated assembly connector 35 interconnecting the scupper plug 32 and hull plug 33 at opposite ends of the scupper hole 20. The adjustable balance assist pole 10, described further below, is substantially hollow and includes pole-end inserts 37, 38 at respective proximal and distal ends 31A, 31B, and an ergonomic soft-grip handle 39 at its distal end 31B for being grasped an occupant (not shown) in a standing position on the kayak 11. As best shown in FIG. 7, the pole-end insert 37 has a cylindrical body 37A, an integrally formed tapered fitting 37B, and a central throughbore 37C extending through the body 37A and tapered fitting 37B. The cylindrical body 37A resides inside the balance assist pole 31 at its proximal end 31A, while the tapered fitting 37B extends outwardly from the pole end 31A. In exemplary embodiments, each of the pole-end inserts 37, 38 may be formed of a metal, molded plastic or high durometer rubber. The pole-end inserts 37, 38 may be affixed to the balance assist pole 31 using adhesives or other bonding agents, or by close frictional engagement with inside walls of the pole 31.

The exemplary scupper plug 32 is located adjacent the proximal end 31A of the balance assist pole 31, and comprises an integrally joined two-piece assembly including a molded rigid core 41 and frustoconical outside liner 42. The core 41 defines a relatively large top socket 44 extending to an inside annular shoulder 45 and a smaller diameter, internally threaded throughbore 46 extending from the shoulder 45 to a bottom end of scupper plug 32. The top socket 44 is configured to closely receive the tapered fitting 37B of pole-end insert 37 at the proximal end 31A of the balance assist pole 31. The outside liner 42 covers an entire length of the core 41 and may be affixed to the core using a suitable adhesive, ultrasonic welding or the like. When the assembly 10 is installed, as described further below, the exemplary scupper plug 32 closely engages an interior wall of the scupper hole 20 adjacent a top mouth 20A of the hole.

The scupper plug 32 may be uniquely designed to fit kayaks of different manufacturer brands and styles, and may be readily removable and exchangeable. The exemplary outside liner 42 of the scupper plug 32 is fabricated of a hard durable plastic (e.g., ABS) to create a precise no-friction fit—avoiding inadvertent lodging of the assembly 10 inside the scupper hole 20 of the kayak 11.

Figure 3:
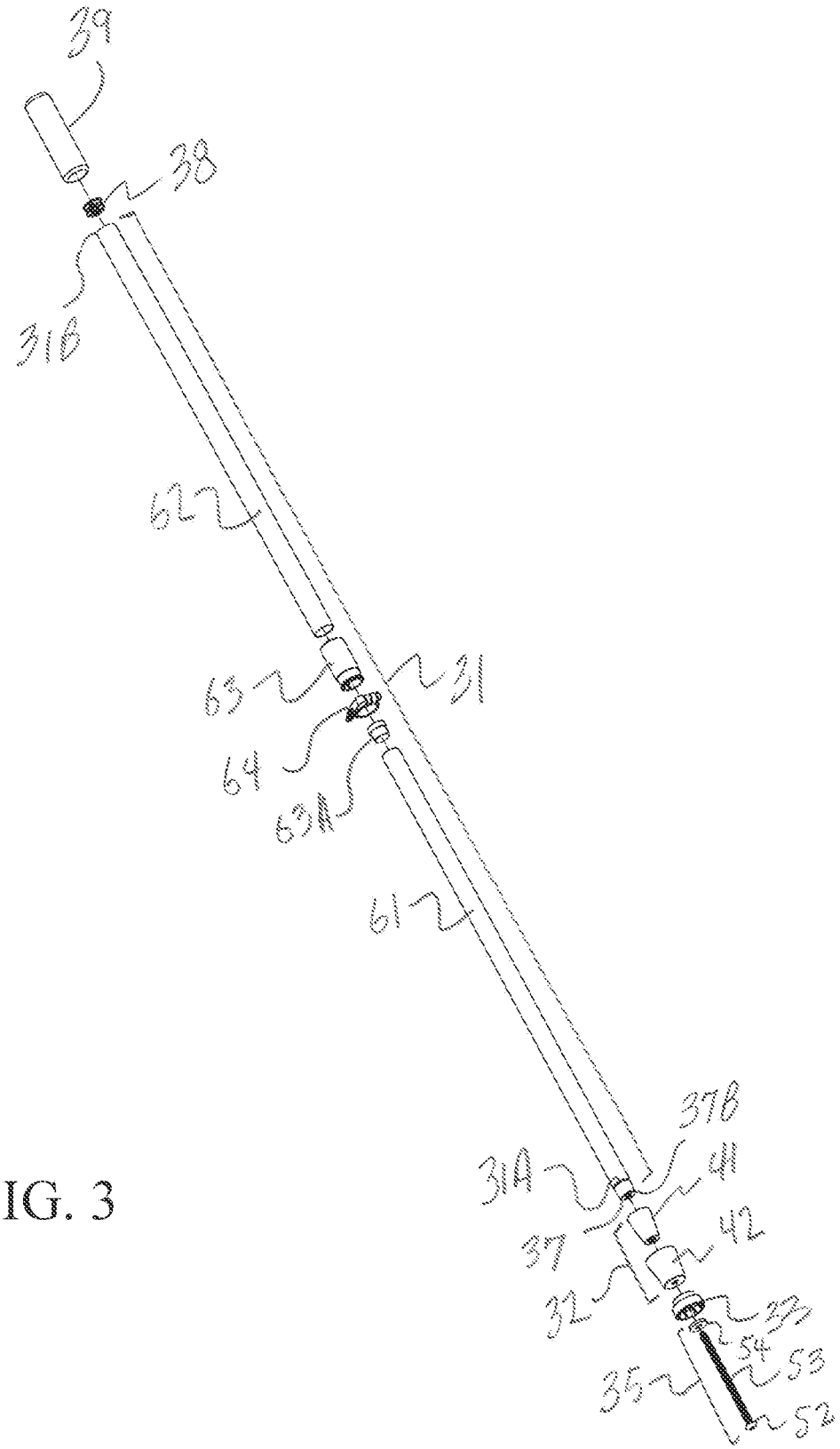
FIG. 3 is an exploded perspective view of the exemplary balance assist assembly.
Figure 4:
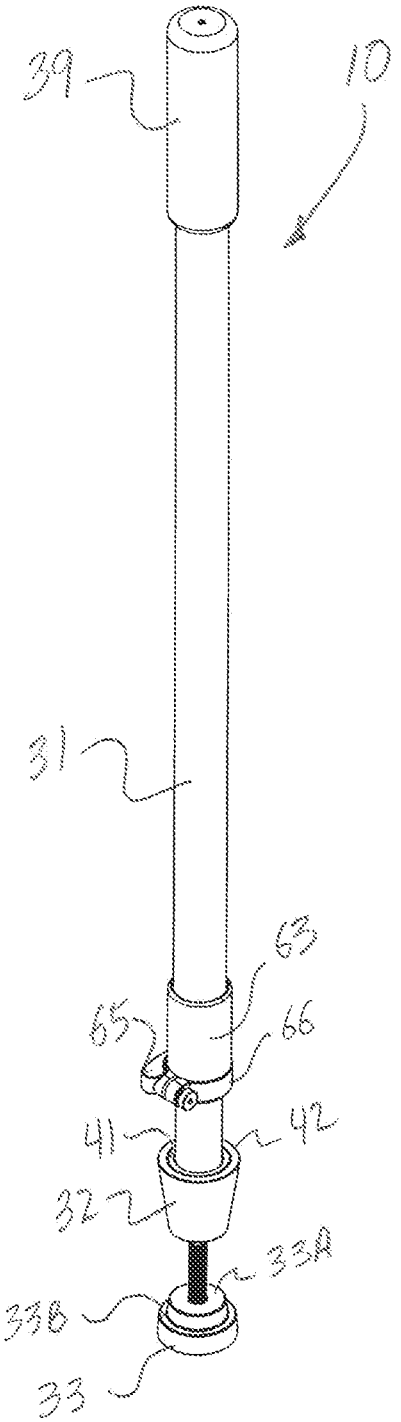
FIG. 4 is a further perspective view showing height adjustable balance assist pole in a lowered (or stowed) condition.
Figure 5:
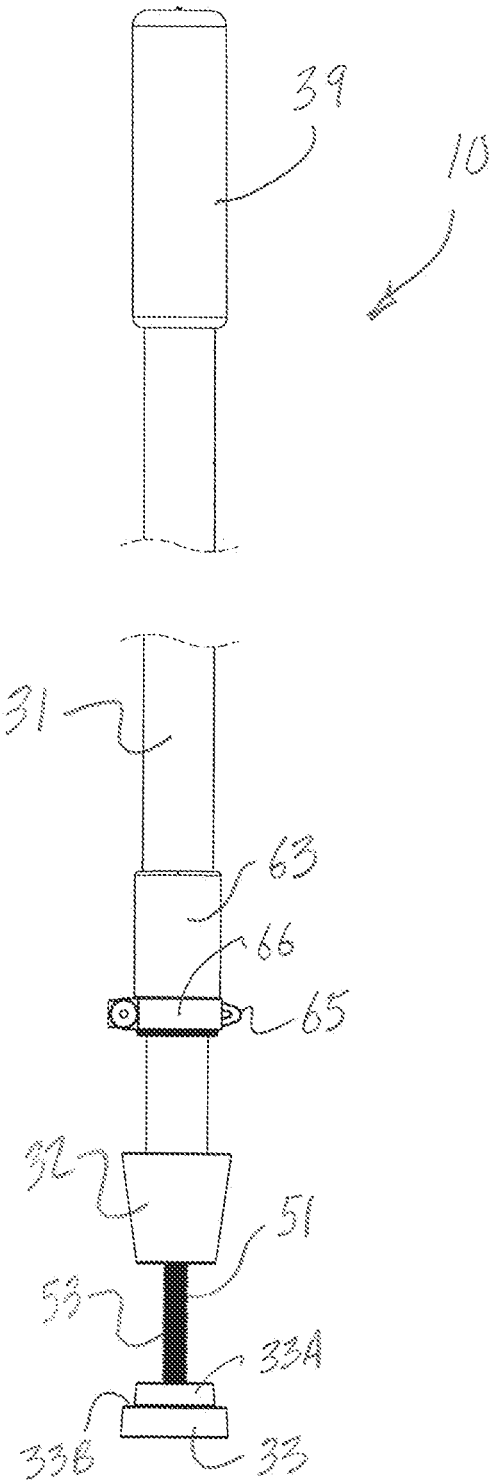
FIG. 5 is side elevation of the exemplary balance assist assembly.
Figure 6:
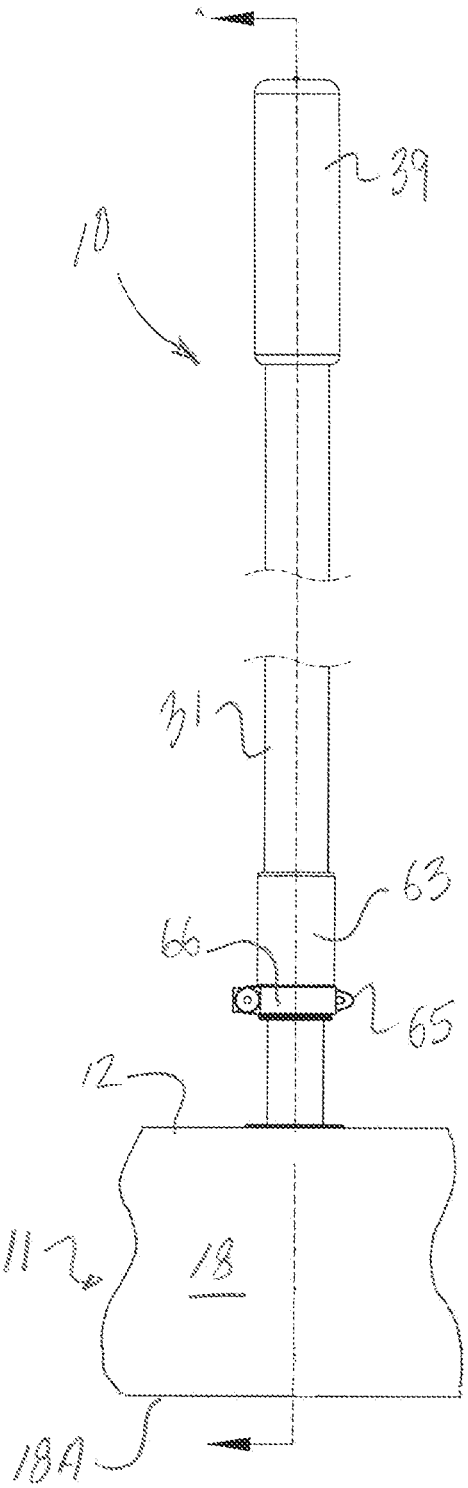
FIG. 6 is a further side elevation of the exemplary balance assist assembly mounted in position within the scupper hole of the kayak.

As best shown in FIGS. 1, 3, and 7, the assembly connector 35 comprises an elongated stainless steel assembly bolt 51 having an enlarged cross-slotted or single slotted head 52, and a threaded length 53. The threaded length is sufficient to extend through the scupper hole 20, through aligned throughbores 46 and 37C of scupper plug 32 and pole-end insert 37, and into the hollow proximal end 31A of the balance assist pole 31. The hull plug 33 is carried by the assembly bolt 51 proximate the bolt head 52 and directly adjacent an enlarged annular (rubber) washer 54, and is precisely molded for a close no-friction fit adjacent a bottom mouth 20B of the scupper hole 20. In the exemplary embodiment, the hull plug 33 has an integrally formed disk-shaped top portion 33A and a stepped-down annular flange 33B configured to seat directly against an internal shoulder 20C of the scupper hole 20 proximate the bottom mouth 20B. When the assembly bolt 51 is tightened using a suitable hand tool (e.g., screwdriver, socket driver/wrench), the threaded length 53 operatively mates with the internally threaded throughbore 46 of scupper plug 32, such that the scupper plug 32 and hull plug 33 are urged into close contact with the kayak 11 proximate respective top and bottom mouths 20A, 20B of the scupper hole 20, thereby securing the balance assist assembly 10 to the kayak 11. The exemplary scupper plug 32 and hull plug 33 may be engineered to the exact dimensions of the kayak scupper hole 20 for a perfect no-friction fit at opposing top and bottom mouths of the hole.

Referring to FIGS. 3-5, 7, 8 and 9, the exemplary balance assist pole 31 of assembly 10 comprises telescoping inner and outer hollow tube sections 61, 62, coupling 63, tube cap 63A, and a quick-release circular clamp 64. The tube sections 61, 62 may be fabricated of a rigid material, such as anodized aluminum, carbon fiber, fiberglass, or plastic. The quick-release clamp 64 incorporates a pivoted lever 65 and clamp collar 66. The clamp collar 66 is designed to operatively engage the coupling 63 in a manner which restricts linear sliding movement of the outer tube section 62 relative to the inner tube section 61. As demonstrated in FIGS. 8 and 9, the height of the balance assist pole 31 is adjusted by first opening the pivot lever 65 to release the clamp collar 66—see direction arrow 71 in FIG. 8. With the clamp collar 66 released, the occupant of kayak grasps the handle 39 and gently lifts the balance assist pole 31 vertically to slidably telescope the outer tube 62 relative to the inner tube 61, as demonstrated by arrow 72 in FIG. 9. Once the balance assist pole 31 is lengthened to a desired extent, the pivoted lever 65 is returned to its original closed position (see direction arrow 73) locking the clamp collar 66 around the coupling 63 to frictionally set the position of outer tube 62, thereby locating the handle 39 of balance assist pole 31 at a comfortable height for use by the standing occupant. The exemplary balance assist assembly 10 creates an additional point-of-contact to help the kayak occupant maintain balance while standing on the cockpit floor, gunwales, seat platform or other deck surface of the kayak 11. Using the present assembly 10, the lateral load and stresses are uniquely transferred outside of the scupper hole 20 to stronger more durable structure of the kayak deck 12 and hull 18.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A personal standing balance assist assembly adapted for use in a recreational watercraft having a deck, a hull bottom, and at least one scupper hole extending vertically from the deck to the hull bottom, said balance assist assembly comprising:

a balance assist pole having opposing proximal and distal ends, the distal end adapted for being grasped by an occupant in a standing position on the recreational watercraft;

a scupper plug located at the proximal end of said balance assist pole and configured to engage the watercraft adjacent a top mouth of the scupper hole;

a hull plug configured to engage the watercraft adjacent a bottom mouth of the scupper hole;

an assembly connector configured to extend vertically through the scupper hole and adapted for urging the scupper plug and hull plug into close contact with the watercraft proximate respective top and bottom mouths of the scupper hole, thereby securing said balance assist assembly to the watercraft.

2. The personal standing balance assist assembly according to claim 1, wherein said balance assist pole comprises telescoping inner and outer hollow tube sections.

3. The personal standing balance assist assembly according to claim 2, and comprising a pole clamp operatively engaging the outer tube section of said balance assist pole, and adapted for releasably securing said balance assist pole at a selected height.

4. The personal standing balance assist assembly according to claim 3, wherein said pole clamp has a quick-release mechanism comprising a pivoted lever and clamp collar, said lever adapted to open and close said clamp collar thereby operatively releasing and securing said balance assist pole for selected height adjustment.

5. The personal standing balance assist assembly according to claim 1, wherein said balance assist pole is fabricated of a material selected from a group consisting of aluminum, carbon fiber, fiberglass, and plastic.

6. The personal standing balance assist assembly according to claim 1, wherein the distal end of said balance assist pole comprises a non-slip handle.

7. The personal standing balance assist assembly according to claim 1, wherein said scupper plug has a substantially frustoconical outer shape.

8. The personal standing balance assist assembly according to claim 1, wherein said scupper plug comprises a core and an outside liner, and wherein said core defines a throughbore configured to receive said assembly connector through said scupper plug and into the proximal end of said balance assist pole.

9. The personal standing balance assist assembly according to claim 8, wherein said core of said scupper plug comprises an internal screw thread, and wherein said assembly connector comprises a complementary threaded bolt configured to mate with the internal screw thread of said core.

10. The personal standing balance assist assembly according to claim 9, wherein said hull plug is carried by said assembly connector proximate an enlarged head of said threaded bolt.

11. The personal standing balance assist assembly according to claim 10, and comprising a washer located between said hull plug and the enlarged head of said threaded bolt.

12. The personal standing balance assist assembly according to claim 1, wherein said hull plug comprises an integrally formed disk-shaped top portion and an annular flange configured to seat adjacent the bottom mouth of the scupper hole.

13. The personal standing balance assist assembly according to claim 1, and comprising a pole-end insert located at the proximal end of said balance assist pole, and having a cylindrical body residing inside said balance assist pole and a tapered outward extending fitting, and wherein said scupper plug defines a socket configured to receive said tapered fitting.

14. In a recreational watercraft having a deck, a hull bottom, and at least one scupper hole extending vertically from the deck to the hull bottom, a balance assist assembly comprising:

a balance assist pole having opposing proximal and distal ends, the distal end adapted for being grasped by an occupant standing upon the recreational watercraft;

a scupper plug located at the proximal end of said balance assist pole and engaging said watercraft adjacent a top mouth of the scupper hole;

a hull plug engaging said watercraft adjacent a bottom mouth of the scupper hole;

an assembly connector extending vertically through the scupper hole and adapted for urging the scupper plug and hull plug into close contact with said watercraft proximate respective top and bottom mouths of the scupper hole, thereby securing said balance assist assembly to said watercraft.

15. The recreational watercraft according to claim 14, wherein said balance assist pole comprises telescoping inner and outer hollow tube sections.

16. The recreational watercraft according to claim 14, wherein the distal end of said balance assist pole comprises a non-slip handle.

17. The recreational watercraft according to claim 14, wherein said scupper plug has a substantially frustoconical outer shape, and defines a central throughbore configured to receive said assembly connector therethrough and into the proximal end of said balance assist pole.

18. The recreational watercraft according to claim 17, wherein said core of said scupper plug comprises an internal screw thread, and wherein said assembly connector comprises a complementary threaded bolt configured to mate with the internal screw thread of said core.

19. The recreational watercraft according to claim 18, wherein said hull plug is carried by said assembly connector proximate an enlarged head of said threaded bolt.

* * * * *